US011013274B2

(12) United States Patent
Larkin

(10) Patent No.: US 11,013,274 B2
(45) Date of Patent: May 25, 2021

(54) SHAPING GARMENTS WITH UPPER LEG SLIMMING BANDS

(71) Applicant: HONEYLOVE SCULPTWEAR, INC., San Francisco, CA (US)

(72) Inventor: Elizabeth Anne Larkin, San Francisco, CA (US)

(73) Assignee: HONEYLOVE SCULPTWEAR, INC., San Francisco, CA (US)

( * ) Notice: Subject to any disclaimer, the term of this patent is extended or adjusted under 35 U.S.C. 154(b) by 200 days.

(21) Appl. No.: 16/029,670

(22) Filed: Jul. 9, 2018

(65) Prior Publication Data

US 2019/0014828 A1 Jan. 17, 2019

Related U.S. Application Data

(60) Provisional application No. 62/533,116, filed on Jul. 16, 2017.

(51) Int. Cl.

| | |
|---|---|
| ***A41B 11/00*** | (2006.01) |
| ***A41B 9/08*** | (2006.01) |
| ***A41B 11/14*** | (2006.01) |
| ***A41C 1/00*** | (2006.01) |
| *A41B 17/00* | (2006.01) |
| *A41B 11/08* | (2006.01) |

(52) U.S. Cl.

CPC ..... *A41B 11/003* (2013.01); *A41B 9/08* (2013.01); *A41B 11/14* (2013.01); *A41C 1/003* (2013.01); *A41B 11/08* (2013.01); *A41B 17/00* (2013.01); *A41B 2400/38* (2013.01); *A41B 2500/20* (2013.01)

(58) Field of Classification Search

CPC ..... A41C 1/04; A41C 1/003; A41B 11/003; A41B 9/08; A41B 11/14; D04B 1/243; D04B 1/24; D04B 21/207

USPC ..... 2/228; 66/169 R, 170, 171, 175, 176; 450/115, 122–124, 131, 132, 101

See application file for complete search history.

(56) References Cited

U.S. PATENT DOCUMENTS

| | | | | |
|---|---|---|---|---|
| 3,431,913 A * | 3/1969 | Bugnon et al. | A41C 1/02 | 450/122 |
| 3,748,870 A * | 7/1973 | Fregeolle | A41B 11/14 | 66/177 |
| 3,877,439 A * | 4/1975 | Locascio | A41C 1/02 | 450/123 |
| 4,390,999 A * | 7/1983 | Lawson | A41B 11/14 | 2/409 |
| 5,201,074 A * | 4/1993 | Dicker | A41D 13/0015 | 2/227 |
| 6,430,752 B1 * | 8/2002 | Bay | A41C 1/003 | 2/228 |
| 7,143,453 B2 * | 12/2006 | Duran | A41B 11/003 | 2/409 |

(Continued)

OTHER PUBLICATIONS

Freddy, "Freddy the art of movement," (https://freddystore.com/), (Accessed Jul. 26, 2018).

*Primary Examiner* — Gloria M Hale

(74) *Attorney, Agent, or Firm* — Fenwick & West LLP

(57) ABSTRACT

Shaping garments including one or more slimming elastic bands are disclosed. In some embodiments, shaping garments include a first horizontal elastic band and a second diagonal elastic band positioned to reshape the inner and outer upper legs creating a slimmer appearance, while also lifting the buttocks.

23 Claims, 7 Drawing Sheets

(56) References Cited

U.S. PATENT DOCUMENTS

| | | | | |
|---|---|---|---|---|
| 7,260,961 | B1 * | 8/2007 | Kennedy | D04B 1/243 66/171 |
| 8,214,926 | B2 * | 7/2012 | Brown | A61F 5/0111 2/228 |
| 8,533,864 | B1 * | 9/2013 | Kostrzewski | A41D 31/185 2/69 |
| 8,647,168 | B2 | 2/2014 | Anvaripour | |
| 9,320,306 | B2 | 4/2016 | Freddi | |
| 9,895,569 | B2 * | 2/2018 | Yao | A63B 21/002 |
| D817,600 | S * | 5/2018 | Brown | D2/731 |
| 2002/0007507 | A1 * | 1/2002 | Duran | A41B 11/003 2/406 |
| 2007/0067892 | A1 * | 3/2007 | Oyama | A41C 1/003 2/227 |
| 2011/0214216 | A1 | 9/2011 | Zarabi | |
| 2012/0156962 | A1 | 6/2012 | Krawchuk | |
| 2013/0316617 | A1 | 11/2013 | Freddi | |
| 2014/0310854 | A1 | 10/2014 | Kianmahd | |
| 2017/0172219 | A1 * | 6/2017 | Liao | A41D 1/06 |

* cited by examiner

SHAPING GARMENTS WITH UPPER LEG SLIMMING BANDS

CROSS-REFERENCE TO RELATED APPLICATIONS

This application claims the benefit of U.S. Provisional Patent Application No. 62,533,116, filed Jul. 16, 2017.

FIELD

The present disclosure relates to shaping garments, specifically to shaping garments with upper leg slimming bands which reshape the inner and outer upper legs creating a slimmer appearance, while also lifting the buttocks.

BACKGROUND

Extra flesh in the upper legs can be difficult to lose through dieting and exercise due to genetics playing the primary role in the structure of this area of the body. Known body shaping garments smooth fat and cellulite by squeezing the body uniformly like a sock but do very little to alter the shape of the upper thighs, which is an area of concern for many people. This uniform squeezing of the legs can also result in bulges where the fabric ends at leg openings.

Some known garments may create the appearance of a more voluptuous buttocks. One known garment is stretchy shorts that encourage the buttocks to protrude through circular cut-outs to lift the bottom. Another known garment uses padding inserted into the backside for creating a larger and more round buttocks.

Lastly, some known garments for shaping the legs and bottom are designed to be worn beneath dresses and skirts, where inner thigh shape is not visible. These garments may squeeze the legs uniformly causing a bulge where the fabric ends at the leg openings.

SUMMARY

Embodiments disclosed herein are directed to shaping garments including upper leg slimming bands that sculpt upper thighs and lift the bottom by shifting extra flesh from the inner and outer upper legs toward the backs of legs, and subsequently upward toward the buttocks. In some embodiments, this sculpting effect is achieved by integrating elastic slimming bands into the back leg area of body shaping undergarments, pantyhose, leggings, or other tight-fitting garments. The bands shift extra flesh on the inner and outer upper legs towards the back of the legs. A garment wearer may then manually adjust the garment so that extra flesh in the buttocks rests above the bands, creating the appearance of a more voluptuous bottom. Shaping garments disclosed herein are well suited for wearing with leggings and pants, where the shape of the user's inner thighs is visible. By moving the flesh deliberately and gently redistributing it, disclosed shaping garments do not produce visible bulges where the fabric ends.

The disclosed shaping garments not only improve the appearance of the buttocks, but also sculpt the appearance the upper thighs without adding any additional bulk to the user's body in the form of padding. Embodiments described in this disclosure provide for a slimmer silhouette in the upper thighs, clear definition between the backs of the legs and the buttocks, and the appearance of a higher and more voluptuous buttocks.

Some embodiments incorporate specially positioned elastic bands in the back of the upper leg area of tight fitting shorts and pants, which may include a foundation undergarment bodysuit, a mid-thigh foundation undergarment, stretch leg tubes, pantyhose, footless pantyhose, and leggings.

In some embodiments, a piece of soft elastic is laid flat diagonally on the inside of the upper back leg of the garment. The elastic is sewn flat so that it rests just under the buttocks near the outer leg seam and extends around the back of the leg diagonally downward to the inner leg seam. In some embodiments, a second piece of soft elastic is positioned horizontally over the diagonal piece of elastic so that it rests just under the buttocks extending from the outer leg seam, to the inner leg seam, just below the crotch. In some embodiments, a compression fabric panel that follows the curve of the buttocks is used in place of the diagonal elastic or horizontal elastic.

Embodiments disclosed herein provide several advantages over known shaping garments. The disclosed shaping garments with upper leg slimming bands specifically target extra flesh in the upper legs, visibly sculpting the inner and outer thighs. Previously known shaping garments may compress the leg equally around its circumference which often results in a bulge where the fabric ends at the leg opening. According to some embodiments, a double layer of elastic also serves to redistribute extra flesh, so that there are no visible bulges at the borders of fabric and elastic. According to some embodiments, a horizontal layer of elastic, which is closest to the user's leg, shifts extra flesh from inner and outer thighs. A diagonal layer of elastic may provide a second layer of compression, which gently redistributes the flesh which has been shifted from the horizontal elastic band. This may prevent bulges from arising below elastic layers and the point where the fabric ends at leg openings.

Disclosed shaping garments with elastic slimming bands do not wrap all the way around the circumference of the legs. Due to this arrangement, extra flesh on the inner side of front femur bone is pushed backward due to the tension caused by the bands being anchored in the inner and outer leg seams. Flesh on the upper outer thighs is pushed backward from the tension of the elastic slimming bands. The front leg area of the garment is not under the tension of the slimming bands because they extend around the back of the legs only. This allows for a release of tension in the front leg, creating a smooth appearance in the front leg and more comfort for the user.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Embodiments disclosed herein provide for shaping garments with upper leg slimming bands. In some embodiments, upper leg slimming bands are constructed using two layers of elastic that are strategically assembled in a way that shifts extra flesh from inner and outer upper thighs backward and upward toward the buttocks, creating a slimmer silhouette in the upper legs and a higher and more defined buttocks.

The disclosed shaping garments specifically target slimming the upper leg area—a region which has not been adequately addressed by previously known shaping garments. These previously known shaping garments do not sufficiently reduce the appearance of extra flesh in the upper leg area, which may be more visible in pants and leggings. Other garments may squeeze the body in a uniform way which causes the extra flesh to release at leg openings, creating a bulge of flesh. Embodiments discussed in further detail below reduce bulging of flesh where the fabric ends at leg openings of garments. In these embodiments, strategically placed upper leg slimming bands shift flesh and redistribute it gradually so that there is decreased bulging in these areas.

The benefits provided by the disclosed shaping garments with upper leg slimming bands include visual slimming of the upper legs, the appearance of a higher buttocks, and better definition between buttocks and legs, creating an overall slimmer and more fit appearance. Shaping garments disclosed herein may be undergarments for wearing underneath clothing. Some embodiments may be especially well suited to wear under slim fitting clothing where the inner upper leg area is visible such as leggings, tight pants, and jeans.

Figure 1A:
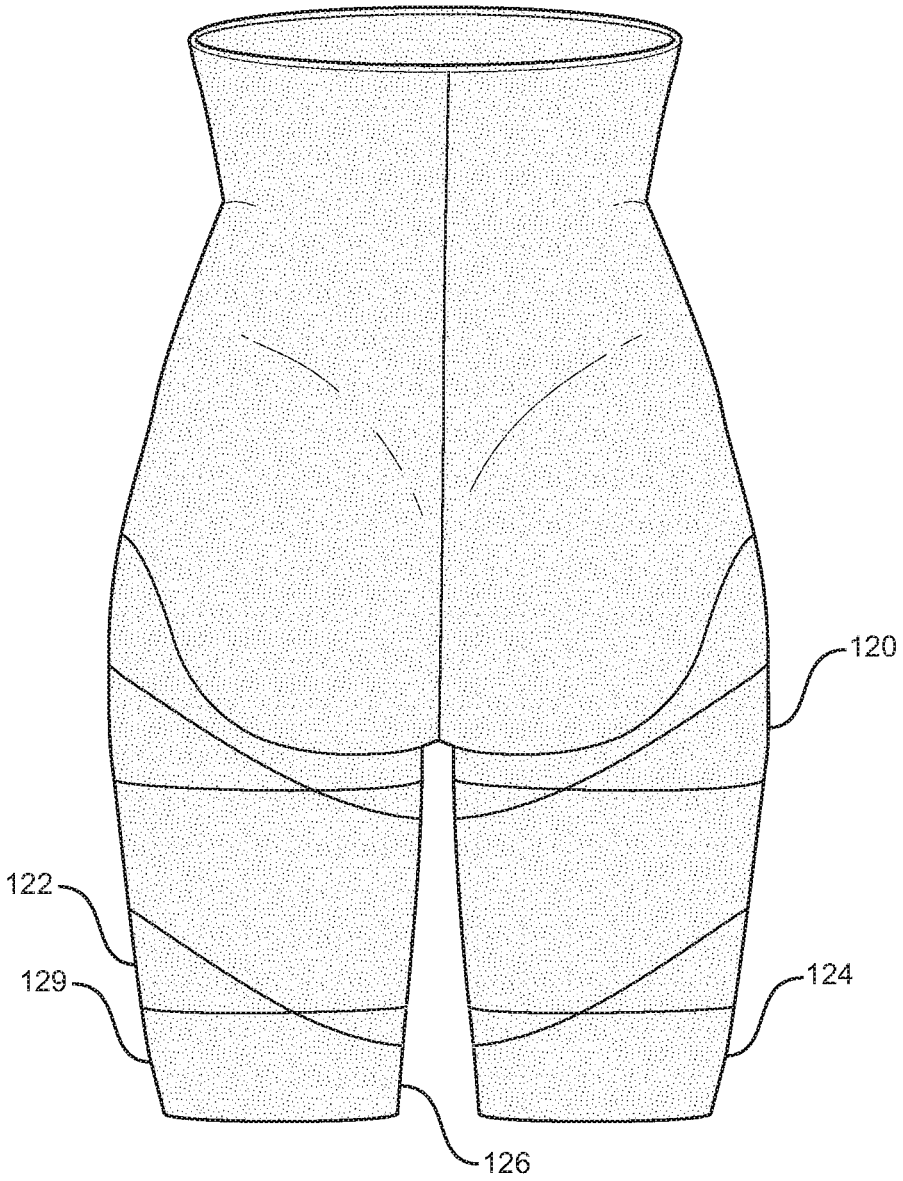
FIG. 1A illustrates a back view of a foundation undergarment with upper leg slimming bands according to an embodiment.
Figure 1B:
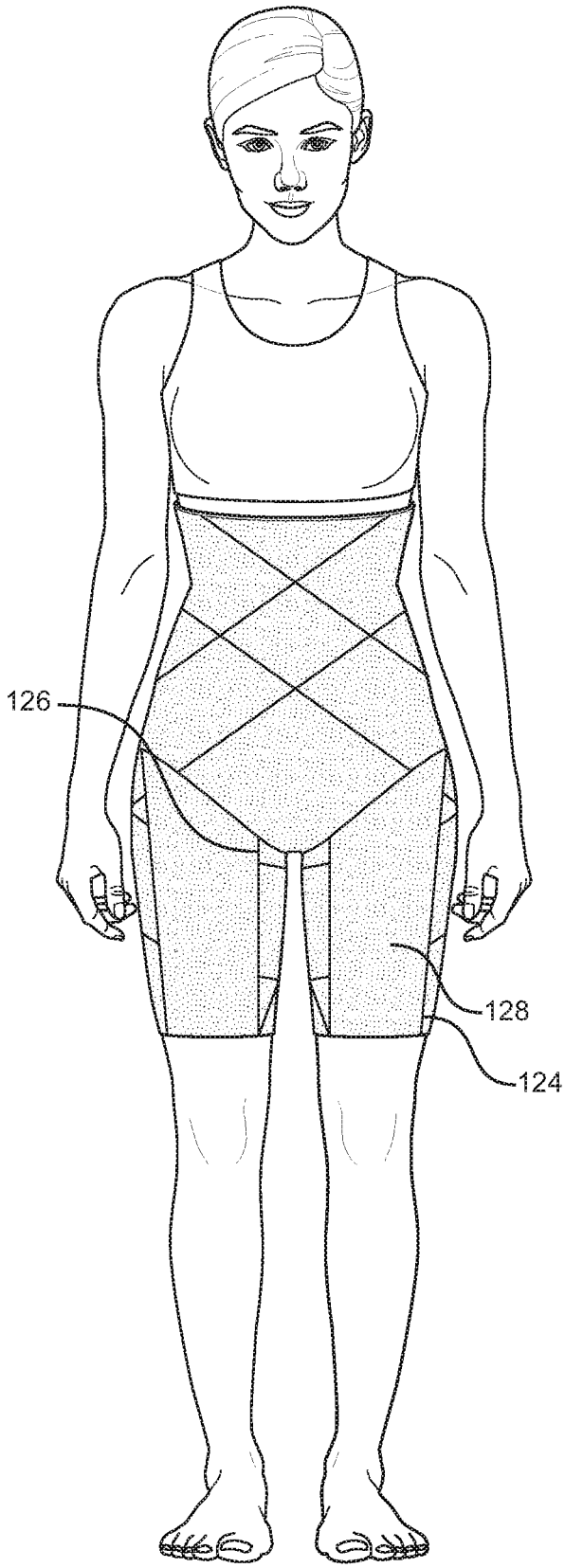
FIG. 1B illustrates a front view of a foundation undergarment with upper leg slimming bands according to an embodiment.
Figure 1C:
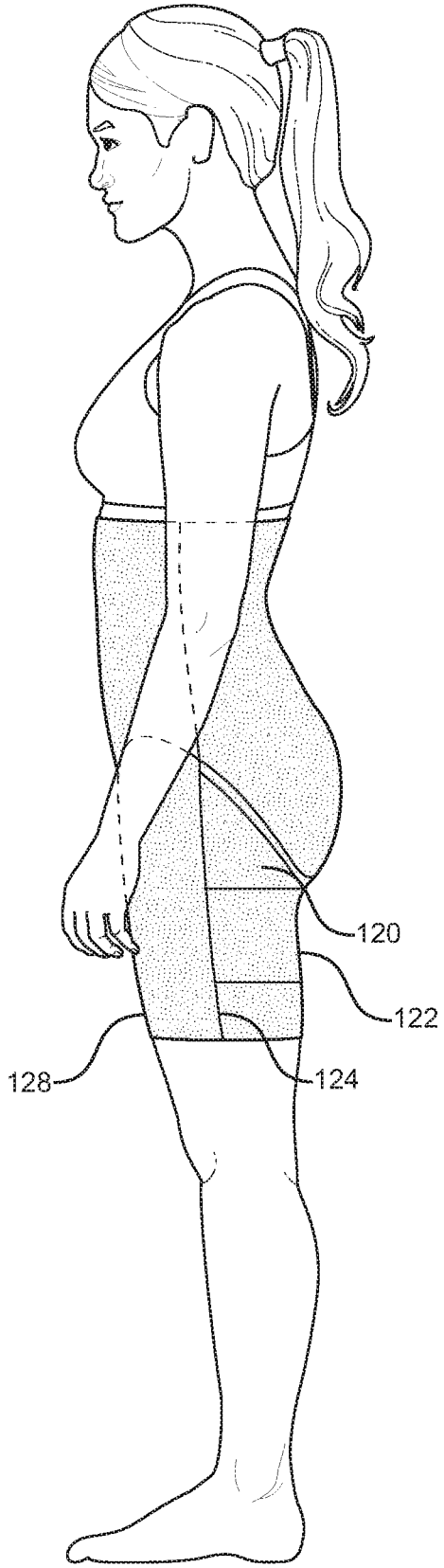
FIG. 1C illustrates a side view of a foundation undergarment with upper leg slimming bands according to an embodiment.

FIG. 1 illustrates various views of a foundation undergarment with upper leg slimming bands according to an embodiment. FIG. 1A is a back view, FIG. 1B is a front view, and FIG. 1C is a side view of the foundation undergarment.

FIG. 1A illustrates a back view of a foundation undergarment with upper leg slimming bands according to an embodiment. The foundation undergarment illustrated in FIG. 1 provides for a large slimmed and shaped area on the inner and outer upper thighs, while also supporting the natural shape of the user's buttocks. Diagonal elastic band 120 supports the area of the buttocks closer to the outer hip, and horizontal elastic band 122 supports and lifts the shape of the user's buttocks closer to the center of the body. The two elastic bands 120 and 122 combined provide a balanced lift of the buttocks. Diagonal elastic band 120 is positioned on the inside of the back leg portion 129 of the garment, extending diagonally from below the top of the outer leg seam portion 124 downward across the back of the leg of the garment to the inner leg seam portion 126.

FIG. 1B illustrates a front view of a foundation undergarment with upper leg slimming bands according to an embodiment. In FIG. 1B, slimming bands are integrated into the back legs of the garment, extending horizontally from the outer leg seam portion 124 along the back of the leg to the inner leg seam portion 126. In this arrangement, front leg portion 128 of the garment is not under the tension of the elastic slimming bands because they extend around the back of the legs only. This allows for a release of tension in the front leg, creating a smooth appearance in the front leg and more comfort for the user. In some embodiments, the side seams are positioned slightly closer to the front of the femur bone, rather than directly centered on the inner and outer thighs. This allows the upper slimming bands to shift more of the flesh away from the inner and outer thighs.

FIG. 1C illustrates a side view of a foundation undergarment with upper leg slimming bands according to an embodiment. Here, elastic bands 120 and 122 are positioned to provide a slimmed and shaped area on the inner and outer upper thighs, while also supporting the natural shape of the user's buttocks. Horizontal elastic band 122 is positioned flat on the inside of the back leg of the garment closest to the skin, extending horizontally from the outer leg seam portion 124 over the back leg to the inner leg. Diagonal elastic band 120 is positioned behind horizontal elastic band 122, extending diagonally from below the top of the outer leg seam 124 downward across the back of the leg to the inner leg. As illustrated, front leg portion 128 of the garment is not under the tension of the elastic slimming bands because they extend around the back of the legs only. In this arrangement, flesh on the upper outer thighs is pushed backward from the tension of elastic bands 120 and 122.

Figures 2A, 2B, 2C:
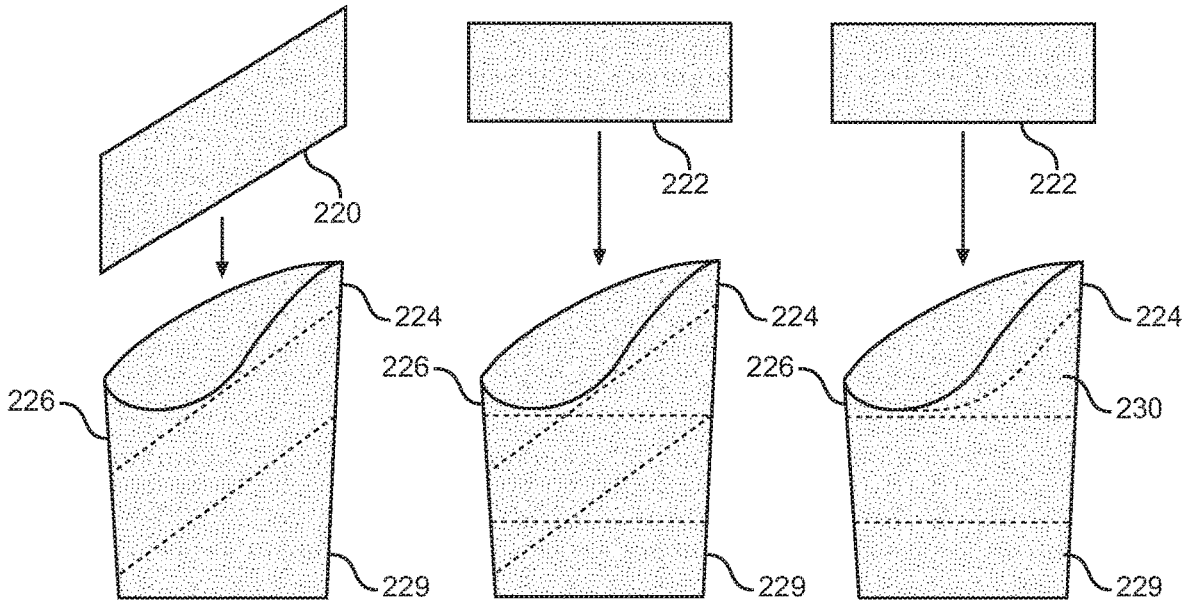
FIG. 2A illustrates a portion of a shaping garment with a diagonal elastic band according to an embodiment.
FIG. 2B illustrates a portion of a shaping garment with a horizontal elastic band according to an embodiment.
FIG. 2C illustrates a portion of a shaping garment with a compression fabric panel according to an embodiment.

FIG. 2 illustrates an example of a shaping garment with a diagonal elastic band according to an embodiment. FIG. 2A shows a diagonal elastic band 220 integrated into a shaping garment. Diagonal elastic band 220 may be a soft elastic band between approximately three to four inches in width. As illustrated in FIG. 2A, diagonal elastic band 220 is positioned and sewn to the inside of the back leg portion 229 of the garment, extending diagonally from below the top of the outer leg seam portion 224 downward across the back of the leg of the garment to the inner leg seam portion 226. In some embodiments, diagonal elastic band 220 is attached to the shaping garment with an edge-stitch along the longer edges to the inner (i.e., skin-facing) side of the shaping garment. In some embodiments, the diagonal elastic band 220 is positioned flat against the back leg of the garment and dimensioned so as to not extend above the back leg fabric into the bottom area of the garment.

FIG. 2B shows a horizontal elastic band 222 integrated into a shaping garment. In FIG. 2B, the shaping garment may be a shaping garment such as that illustrated in FIG. 2A, with a horizontal elastic band. In an embodiment, horizontal elastic band 222 may be a soft elastic band between approximately three to four inches. As illustrated in FIG. 2B, horizontal elastic band 222 is positioned flat extending horizontally from the outer leg seam portion 224 to the inner leg seam portion 226. In the example shaping garment illustrated in FIG. 2B, the top of horizontal elastic band 222 rests approximately ¼ inch to ½ inch below the bottom when the shaping garment is on the user's body. In some embodiments, the top and bottom of horizontal elastic band 222 are edge-stitched to the shaping garment so that horizontal elastic band 222 is affixed flat over the diagonal elastic on the inner (i.e., skin-facing) side of the shaping garment.

FIG. 2C shows a horizontal elastic band 222 integrated into a shaping garment. In FIG. 2C, the shaping garment may be a shaping garment such as that illustrated in FIG. 2B, but with a compression fabric panel 230 in place of a diagonal elastic band. The compression fabric panel 230 may be cut in a specific shape that follows the curve of the buttocks. Compression fabric panel 230 serves a similar function as the diagonal elastic band of FIG. 2B and is incorporated, such as by sewing, into the back leg portion of the garment in a way that follows the curve of the user's bottom. The compression fabric panel 230 may be smoother under clothing and more form-fitting than a diagonal elastic band because it covers a wider area and has a more natural circular or curved outline compared to the straight lines of an elastic band. Horizontal elastic band 222 is positioned flat extending horizontally from the outer leg seam portion 224 to the inner leg seam portion 226 across the compression fabric panel 230, such that the horizontal elastic band 222 is on the inner (i.e., skin-facing) side of the garment. In general, any elastic band described in any embodiment in this disclosure may be replaced with a similar compression fabric panel to serve a similar function. Aspects of other embodiments in this disclosure may be applied equally to the embodiment in FIG. 2C.

Figure 3:
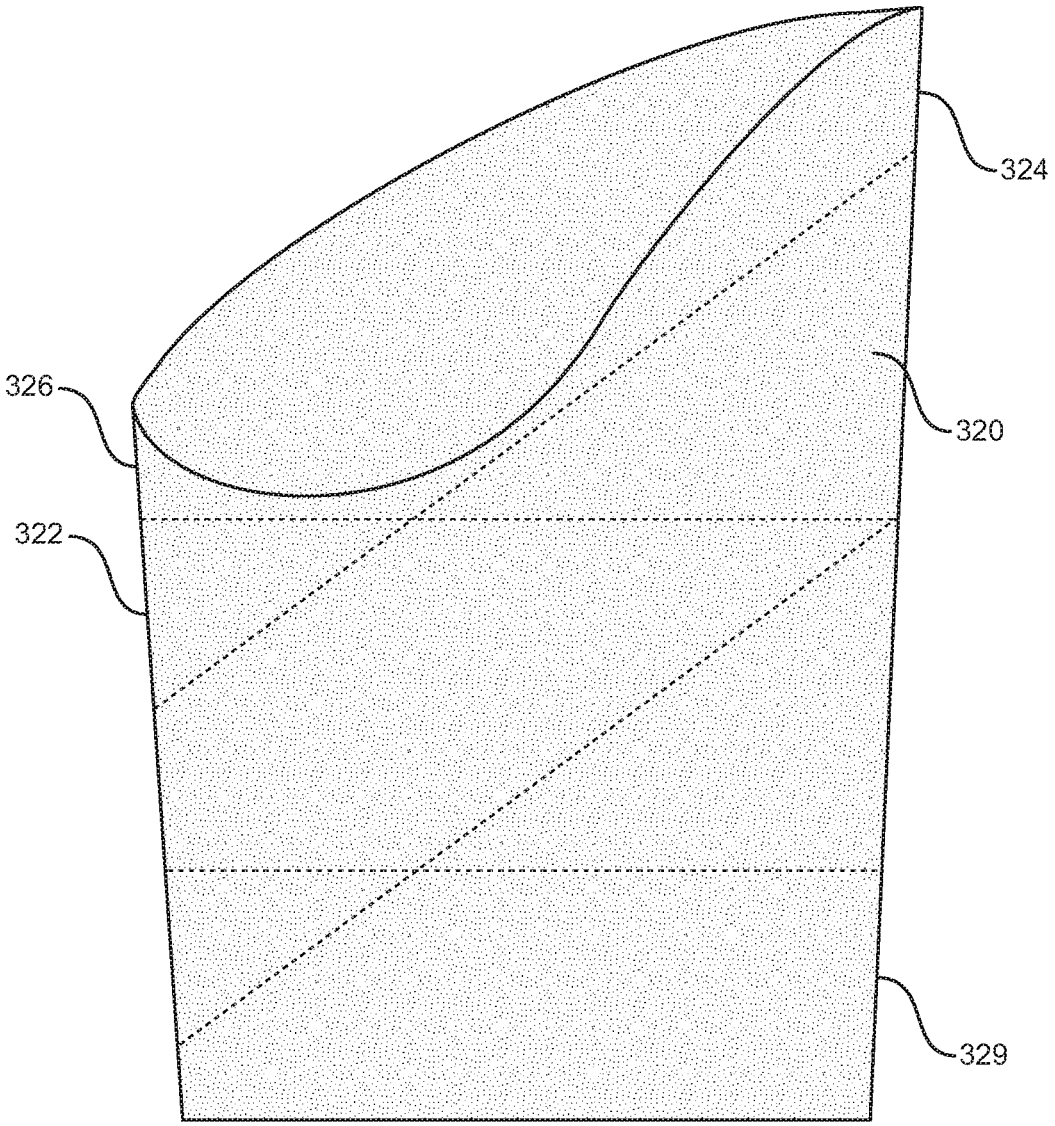
FIG. 3 illustrates an inside-out view of the leg of a foundation undergarment with upper leg slimming bands according to an embodiment.

FIG. 3 illustrates an example of a shaping garment with a diagonal elastic band and a horizontal elastic band according to an embodiment. FIG. 3 provides a close-up view of the inside-out leg of a shaping garment with upper leg slimming bands integrated. Diagonal elastic band 320 is sewn into the inside back leg of a garment starting at a point roughly two inches from the top of the outer leg seam 324 around the back of the leg to the inseam. Horizontal elastic band 322 is sewn into the inseam 326 at a point beginning approximately ¼ inch to ½ inch below the top of the garment's inseam, around the back of the leg, where it is then sewn into the outer leg seam. Elastic bands 320 and 322 may be anchored into side seams using a serger or overlock sewing machine. The bands may also be edge-stitched along the top and bottom. In some embodiments, the elastic is sewn flat to the back leg of the garment to prevent any rippling in the fabric.

The upper leg slimming bands are comprised of two layers of elastic, one that runs diagonally and one that runs horizontally around the back of the leg between inner and outer side seams. The horizontal elastic band 322 rests directly against the skin. The diagonal elastic band 320 engages the extra flesh which arises at the edges of the horizontal elastic band 322 and redistributes it so that there is no visible bulging at the borders of the elastic bands. In some embodiments, the order of the elastic bands may be reversed such that the diagonal elastic rests closest to the skin and the horizontal elastic is behind the diagonal elastic.

Figure 4:
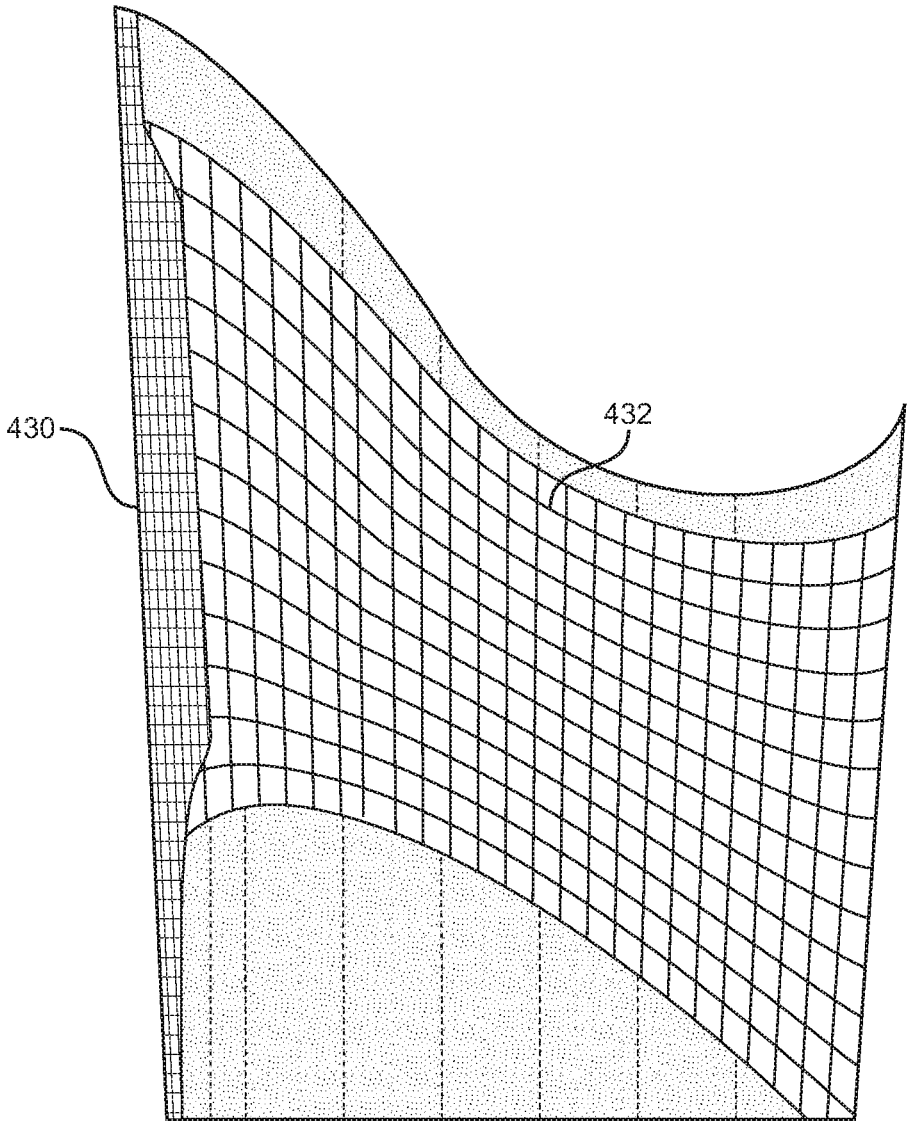
FIG. 4 illustrates a shaping garment with upper leg slimming bands integrated into the weave of the fabric of the garment.

FIG. 4 illustrates a shaping garment with upper leg slimming bands integrated into the weave of the fabric of the garment. In an embodiment, the integrated upper leg sliming bands may be constructed using a gradual weaving method. In this embodiment, upper leg slimming bands are woven directly into the back leg of the garment using gradually increasing layers of elastic thread. In the upper area of legs which are often more fleshy, a thicker weave portion 430 provides additional support. A thinner weave portion 432 of elastic thread is used near the bottom leg area of the garment.

A shaping garment with upper leg slimming bands constructed using a gradual weave such as illustrated in FIG. 4 may provide for a more seamless look under clothing. Because the elastic weave is progressively transitioned from thicker to thinner, the flesh is compressed with sufficient strength while being absorbed and redistributed gradually due to the gradual weave transition from the thicker elastic center to the thinner edges. The elastic weave gradually transitions from thicker to thinner weave along the garment from the upper leg area to the bottom leg area. This gradual weave provides for greater compression in the fleshiest part of the leg and gradually lower compression towards the lower leg area of the garment so that there is no bulging at the place where the fabric ends at the leg openings.

While illustrated in the context of one type of shaping garment in FIG. 4, any embodiment of shaping garment may use the gradual weave described here. For example, upper leg slimming bands constructed using a gradual weaving method may be integrated into foundation undergarment bodysuits, mid-thigh foundation undergarments, compression leg tubes, pantyhose, footless pantyhose, and leggings, among others.

FIG. 5 illustrates various examples of shaping garments with integrated upper leg slimming bands. Each illustrated example embodiment shows the positions of a diagonal elastic band 520 and a horizontal elastic band 522 relative to a front leg portion 528 and/or a back leg portion 529 of various garment styles. In each example, diagonal elastic band 520 and horizontal elastic band 522 may be either discrete elastic bands attached to the garment or elastic thread woven into the garment such as discussed in relation to FIG. 4.

Figure 5A:
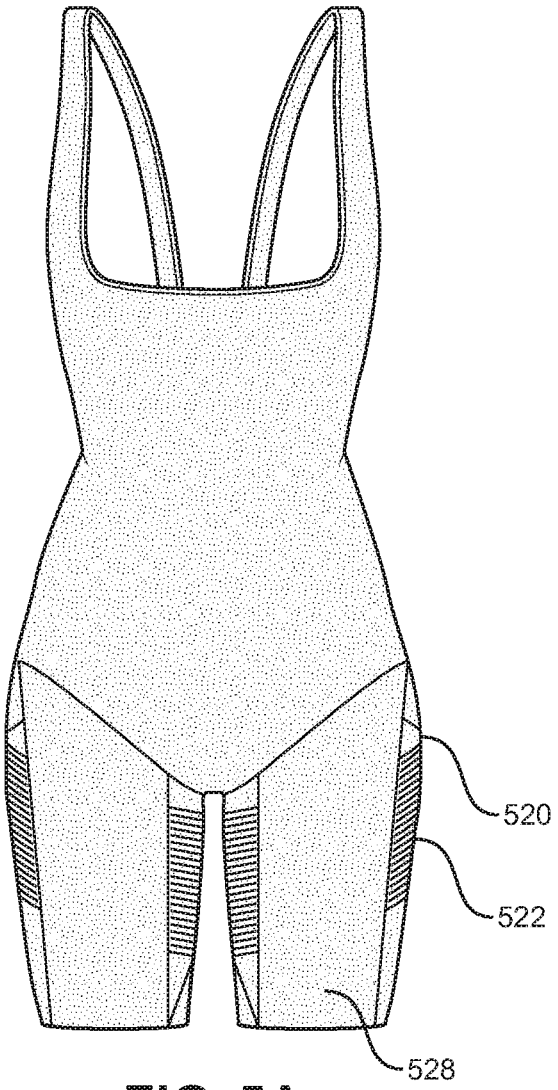
FIG. 5A illustrates a foundation undergarment bodysuit with upper leg slimming bands according to an embodiment.
Figure 5B:
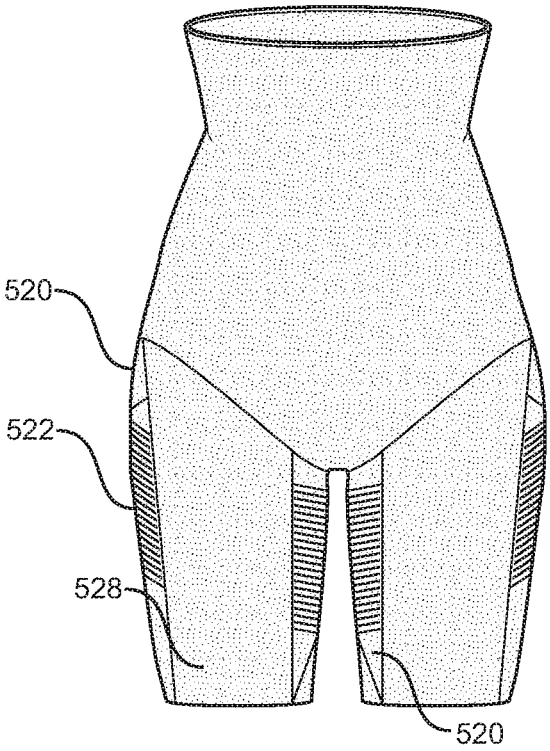
FIG. 5B illustrates a mid-thigh foundation undergarment with upper leg slimming bands according to an embodiment.
Figure 5C:
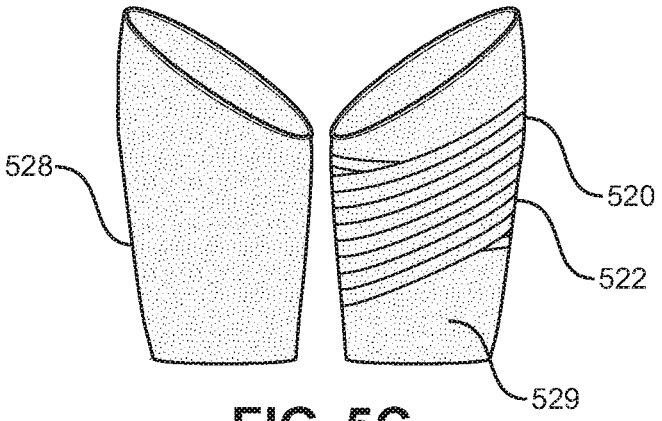
FIG. 5C illustrates compression leg tubes with upper leg slimming bands according to an embodiment.
Figure 5D:
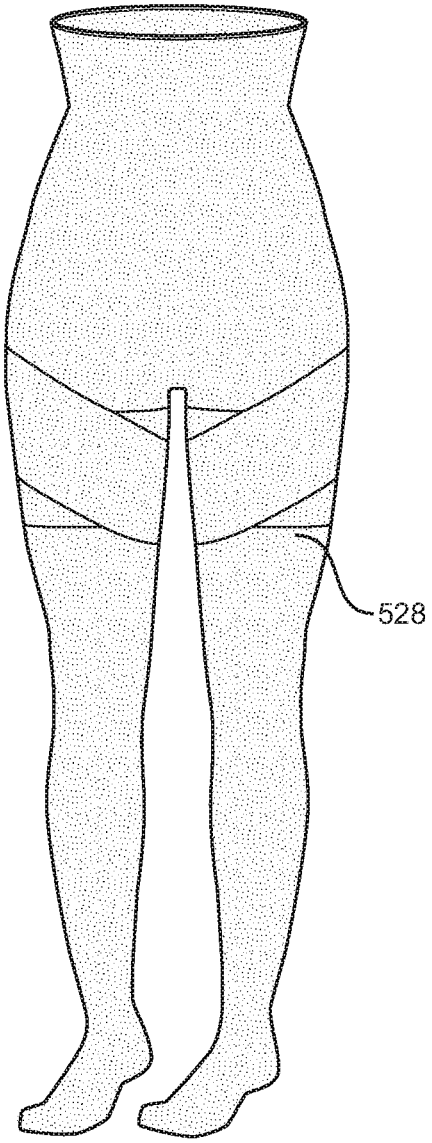
FIG. 5D illustrates pantyhose with upper leg slimming bands according to an embodiment.
Figure 5E:
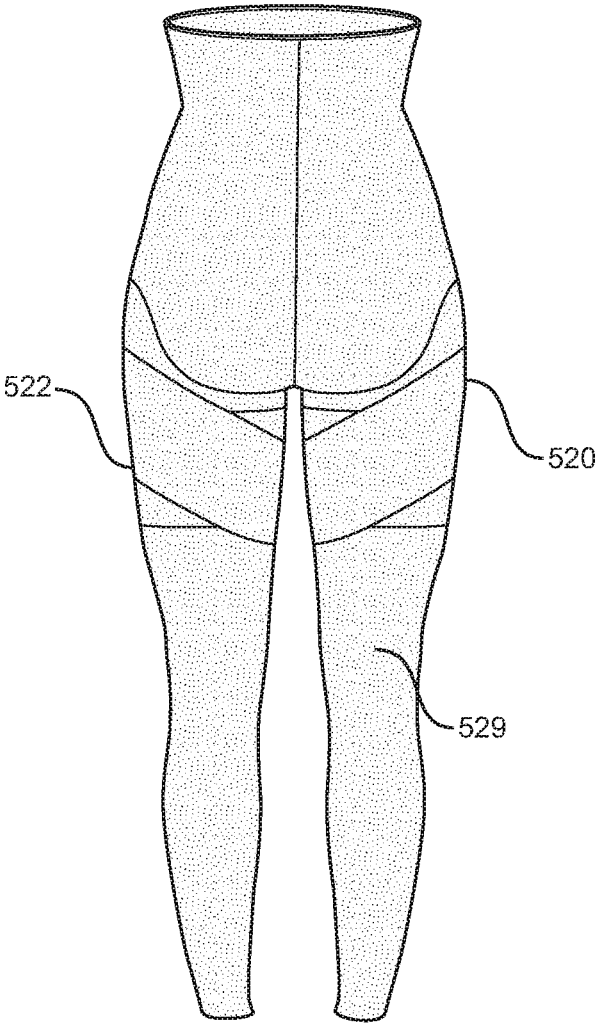
FIG. 5E illustrates footless pantyhose and leggings with upper leg slimming bands according to an embodiment.

FIG. 5A illustrates a foundation undergarment bodysuit with upper leg slimming bands according to an embodiment. FIG. 5B illustrates a mid-thigh foundation undergarment with upper leg slimming bands according to an embodiment. FIG. 5C illustrates compression leg tubes with upper leg slimming bands according to an embodiment. FIG. 5D illustrates pantyhose with upper leg slimming bands according to an embodiment. FIG. 5E illustrates footless pantyhose and leggings with upper leg slimming bands according to an embodiment. In each of these examples, upper leg slimming bands sculpt upper thighs and lift the bottom by shifting extra flesh from the inner and outer upper legs toward the backs of legs, and subsequently upward toward the buttocks, creating the appearance of a more voluptuous bottom.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A sculpting undergarment, comprising;

a front leg portion having a top end and a bottom end;

a back leg portion having a top end and a bottom end, the back leg portion attached to the front leg portion along an inner leg seam and an outer leg seam;

a horizontal elastic band positioned at the back leg portion of the undergarment, the horizontal elastic band extending from the inner leg seam to the outer leg seam; and a diagonal elastic band positioned at the back leg portion of the undergarment, the diagonal elastic band extending diagonally from the outer leg seam to the inner leg seam, wherein the horizontal elastic band and the diagonal elastic band comprise elastic thread woven into the back leg portion, the elastic thread is woven in a first weave toward the top end of the back leg portion and is woven in a second weave toward the bottom end of the back leg portion, and the first weave is thicker than the second weave.

2. The sculpting undergarment of claim 1, wherein the horizontal elastic band and the diagonal elastic band are elastic bands stitched to the back leg portion.

3. The sculpting undergarment of claim 2, wherein the horizontal elastic band and the diagonal elastic band are edge-stitched to the back leg portion.

4. The sculpting undergarment of claim 1, wherein the elastic thread gradually transitions from the first weave toward the top end of the back leg portion to the second weave toward the bottom end of the back leg portion.

5. The sculpting undergarment of claim 1, wherein the front leg portion provides substantially less compression compared to the horizontal elastic band and the diagonal elastic band.

6. The sculpting undergarment of claim 1, wherein a lateral axis of the horizontal elastic band is substantially parallel to the outer leg seam.

7. The sculpting undergarment of claim 1, wherein a top of the horizontal elastic band is positioned to rest approximately ¼ to ½ inch below buttocks of a user when the sculpting undergarment is worn by the user.

8. The sculpting undergarment of claim 1, wherein the horizontal elastic band and the diagonal elastic band are approximately 3 to 4 inches in width.

9. The sculpting undergarment of claim 1, wherein the diagonal elastic band is attached to the outer leg seam approximately between 1 to 3 inches below a top end of the outer leg seam.

10. A sculpting undergarment, comprising;

a front leg portion having a top end and a bottom end; and a back leg portion having a top end and a bottom end, the back leg portion attached to the front leg portion along an inner leg seam and an outer leg seam, wherein elastic thread is woven into the back leg portion in a horizontal area extending from the inner leg seam to the outer leg seam and in a diagonal area extending from the outer leg seam to the inner leg seam, the elastic thread is woven in a first weave toward the top end of the back leg portion and is woven in a second weave toward the bottom end of the back leg portion, and the first weave is thicker than the second weave.

11. The sculpting undergarment of claim 10, wherein the elastic thread gradually transitions from the first weave toward the top end of the back leg portion to the second weave toward the bottom end of the back leg portion.

12. The sculpting undergarment of claim 10, wherein the front leg portion provides substantially less compression compared to the back leg portion.

13. The sculpting undergarment of claim 10, wherein the horizontal area and the diagonal area are approximately 3 to 4 inches in width.

14. A garment, comprising:

a horizontal elastic portion at a back side of a leg of the garment, the horizontal elastic portion extending from an inner leg portion to an outer leg portion; and a diagonal elastic portion at the back side of the leg of the garment, the diagonal elastic portion extending from a top end of the outer leg portion to a bottom end of the inner leg portion, wherein the horizontal elastic portion and the diagonal elastic portion comprise elastic thread woven into the back leg portion, the elastic thread is woven in a first weave toward the top end of the back leg portion and is woven in a second weave toward the bottom end of the back leg portion, and the first weave is thicker than the second weave.

15. The garment of claim 14, wherein the horizontal elastic portion and the diagonal elastic portion are elastic bands stitched to the back side of the leg of the garment.

16. A sculpting undergarment, comprising:

a front leg portion having a top end and a bottom end;

a back leg portion having a top end and a bottom end, the back leg portion attached to the front leg portion along an inner leg seam and an outer leg seam;

a compression fabric panel shaped based on curve of buttocks of a user, the compression fabric panel positioned at the back leg portion of the undergarment; and a horizontal elastic band positioned at the back leg portion of the undergarment, the horizontal elastic band extending from the inner leg seam to the outer leg seam across the compression fabric panel, wherein the front leg portion provides substantially less compression compared to the back leg portion.

17. The sculpting undergarment of claim 16, wherein the front leg portion provides substantially less compression compared to the horizontal elastic band and the compression fabric panel.

18. The sculpting undergarment of claim 16, wherein a top of the horizontal elastic band is positioned to rest approximately ¼ to ½ inch below buttocks of a user when the sculpting undergarment is worn by the user.

19. The sculpting undergarment of claim 16, wherein the horizontal elastic band is approximately 3 to 4 inches in width.

20. The sculpting undergarment of claim 1, wherein the horizontal elastic band is positioned in the sculpting undergarment such that when a user wears the sculpting undergarment, the horizontal elastic band rests on a thigh of the user to shift flesh of the thigh of the user.

21. The sculpting undergarment of claim 20, wherein the diagonal elastic band is positioned relative to the horizontal elastic band such that the diagonal elastic band engages a part of the flesh shifted by the horizontal elastic band and redistributes the part of the flesh.

22. The sculpting undergarment of claim 21, wherein the part of the flesh is shifted by an edge of the horizontal elastic band.

23. The sculpting undergarment of claim 1, wherein the diagonal elastic band is positioned relative to the horizontal elastic band such that when a user wears the sculpting undergarment, at least a portion of the horizontal elastic band is closer to the user's skin than at least a portion of the diagonal elastic band.

* * * * *